United States Patent [19]

Ide

[11] 4,168,009

[45] Sep. 18, 1979

[54] AUTOMATIC DISCHARGE CARGO LIFTING APPARATUS

[76] Inventor: Allan R. Ide, 10066 Bloomfield, Cypress, Calif. 90630

[21] Appl. No.: 781,186

[22] Filed: Mar. 25, 1977

Related U.S. Application Data

[63] Continuation-in-part of Ser. No. 704,238, Jul. 12, 1976, abandoned.

[51] Int. Cl.[2] ..... B63B 27/28

[52] U.S. Cl. ..... 414/140; 198/572; 198/575; 198/796; 198/800; 198/862

[58] Field of Search ..... 214/12, 14, 15 R, 15 D, 214/6 FA, 15 E, 16.1 CE, 16.1 BB; 198/341, 468, 469, 471, 477, 482, 572, 575, 606, 862, 796, 857, 793, 797, 799, 800, 856, 863

[56] References Cited

U.S. PATENT DOCUMENTS

| | | | |
|---|---|---|---|
| 1,525,950 | 2/1925 | Prescott | 214/14 |
| 1,799,924 | 4/1931 | Muzyn | 198/800 |
| 1,887,456 | 11/1932 | LeGette | 198/572 |
| 2,158,069 | 5/1939 | Grover | 198/856 |
| 2,307,665 | 1/1943 | Carmichael | 198/796 X |
| 3,268,055 | 8/1966 | Stein et al. | 198/575 X |
| 3,371,769 | 3/1968 | Beninger | 198/482 |
| 3,403,794 | 10/1968 | Lopez | 198/796 X |
| 3,796,325 | 3/1974 | Ide | 214/15 E |

FOREIGN PATENT DOCUMENTS

| | | | |
|---|---|---|---|
| 77010 | 1/1954 | Denmark | 214/14 |
| 84815 | 5/1957 | Netherlands | 214/14 |
| 258449 | 9/1926 | United Kingdom | 198/863 |
| 894829 | 4/1962 | United Kingdom | 198/797 |

*Primary Examiner*—Frank E. Werner

*Attorney, Agent, or Firm*—Fulwider, Patton, Rieber, Lee & Utecht

[57] ABSTRACT

There is disclosed an automatic cargo transport apparatus for moving cargo between different vertical levels in which endless chains are synchronized to move along vertical ascending and descending paths in an elevator gantry. Laterally extending cargo loading and cargo discharge conveyors are located at different vertical levels to transfer boxes of cargo to and from pairs of cradles moving respectively in ascending and descending vertical directions within the gantry. Discharge sensors detect unwithdrawn units of cargo at the cargo unloading space and inhibit further operation of the cargo transport until this condition is corrected. Loading sensors detect the ascending movement of cradles at the cargo loading station and synchronize the interpositioning of cargo loads at the cargo loading space. The vertically oriented elevator system is suspended from a supporting framework positioned on the coaming of the hold of a ship so that the elevator system hangs in pendulum fashion, and retains a vertical orientation despite movement of the ship. The chains carrying the cradles include guide blocks that ride within vertically extending channels to prevent twisting of the chain links at the cradle connections. Vertically extending rails define elevator shafts so that units of cargo are laterally restrained and cannot become dislodged and fall. The vertically extending elevator framework is constructed in modular sections so that the cargo transport apparatus can be lengthened or shortened. Also, a cargo loading rack and a unloading rack are provided to respectively receive the laterally extending cargo loading and unloading conveyors, and can be selectively positioned along the vertically extending framework so cargo transport between different levels may be achieved.

14 Claims, 19 Drawing Figures

FIG. 3
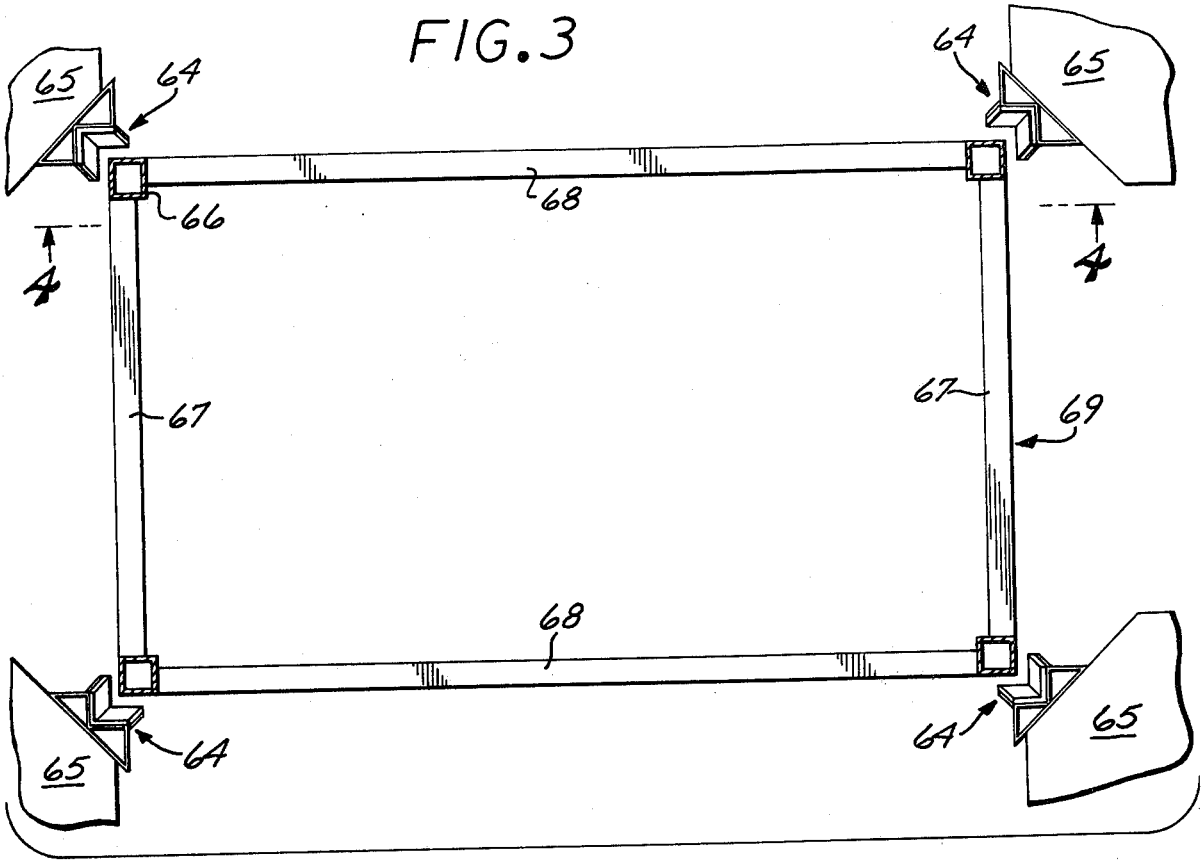
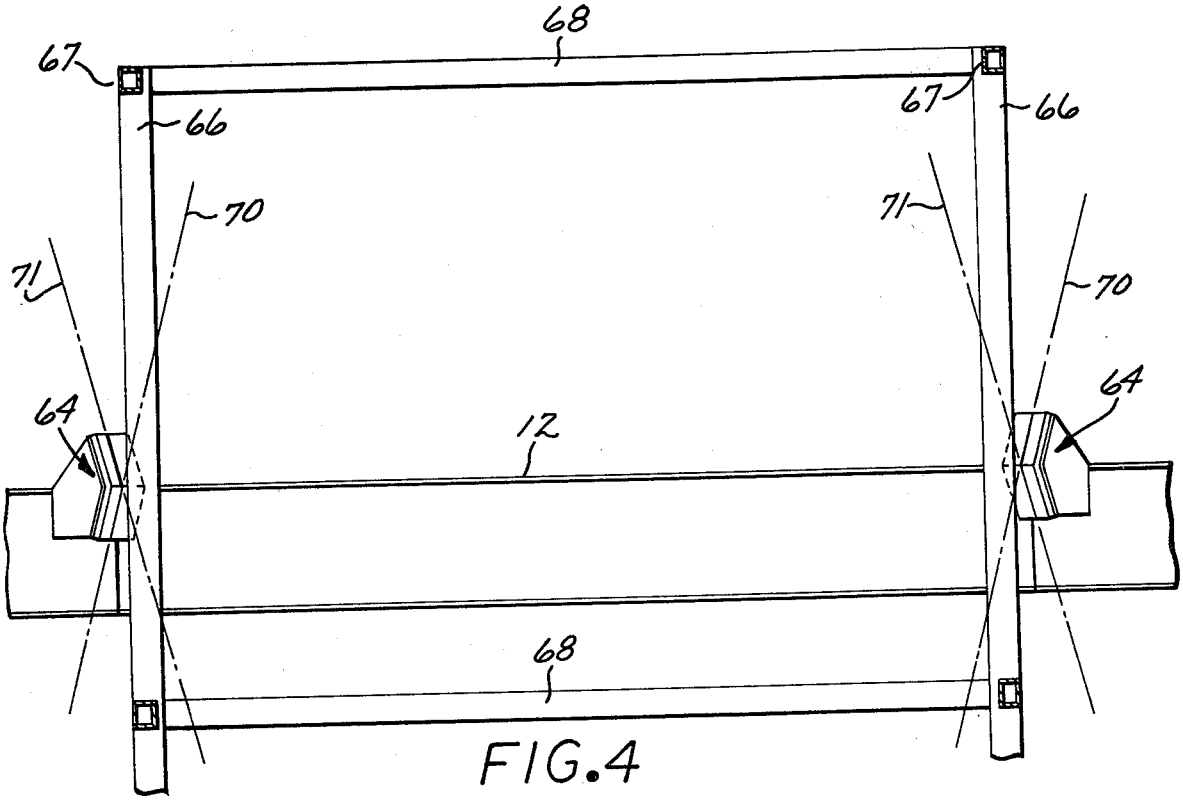
FIG. 4

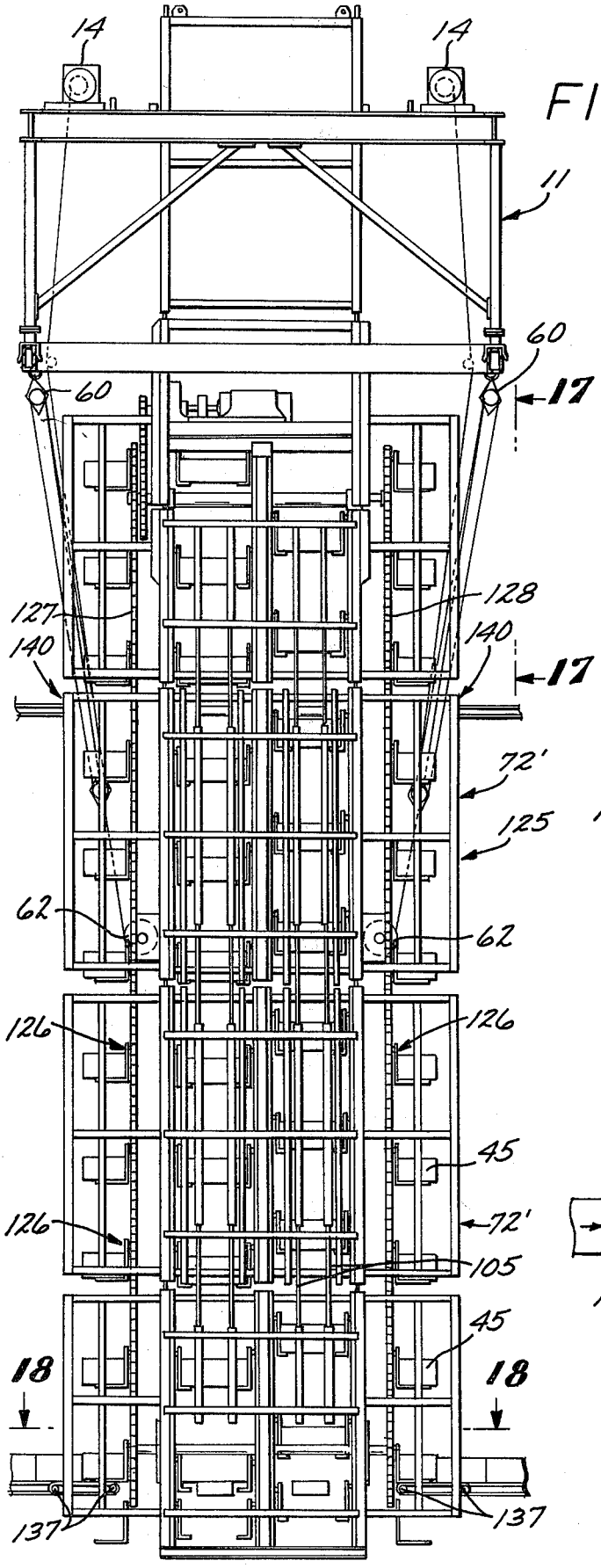
FIG. 16
FIG. 17
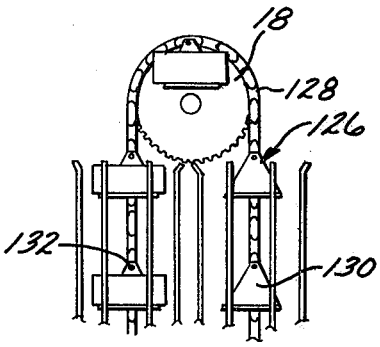
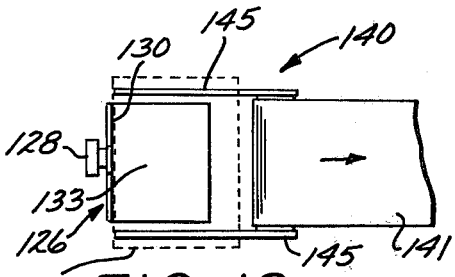
FIG. 19
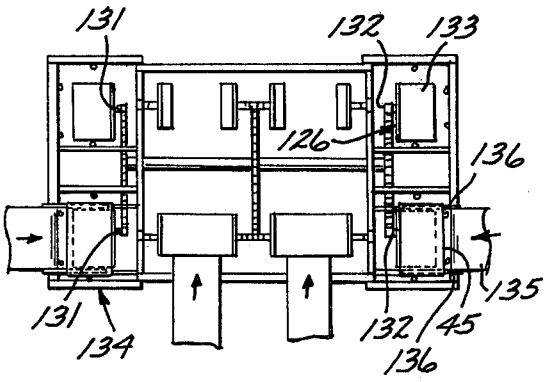
FIG. 18

AUTOMATIC DISCHARGE CARGO LIFTING APPARATUS

BACKGROUND OF THE INVENTION

1. Field of the Invention

This is a continuation-in-part of U.S. patent application Ser. No. 704,238 filed on July 12, 1976, now abandoned.

The automatic cargo transport apparatus of the present invention relates to a device for loading and unloading cargo from a ship or the like.

2. Description of the Prior Art

Numerous different conveyor systems have been proposed for loading and unloading cargo ships some of which have incorporated vertical extending conveyors formed with vertically spaced apart, horizontally disposed trays formed with openings for passage therethrough of interfingered loading or unloading devices which act to unload such trays as they pass thereby. Such devices suffer the shortcoming that synchronization of the loading devices and travel of the trays becomes critical and the systems themselves are far from foolproof in operation.

SUMMARY OF THE INVENTION

The automatic cargo transport apparatus of the present invention is characterized by a vertically disposed elevator gantry in which endless loops of chain traveling in vertically ascending and descending paths carry pivotally mounting vertically elongated cradles in pendulum fashion. The cradles are formed by oppositely disposed hangers which are turned inwardly at their lower extremities to form horizontally disposed flanges which terminate in spaced apart edges defining therebetween and unloading space at a cargo discharge station and a loading space at a cargo loading station. At the discharge space, the hangers pass downwardly on the opposite sides of the laterally oriented cargo discharge conveyor to deposit cargo carried thereon while the flanges of the cradles pass on either side of the discharge conveyor in a continuous descending motion. Similarly, the cradles receive units of cargo carried to a cargo loading station by a horizontally disposed loading conveyor of a width such that the units of cargo overhang the opposed edges of the conveyor. The ascending cradles lift the units of cargo at the cargo loading station and carry the units of cargo to the cargo discharge station.

Discharge sensors are provided to prevent a cargo pileup at the cargo discharge station. While normally the cargo discharge conveyor quickly withdraws a box of cargo from descending cradles passing by the cargo discharge station, a malfunction might occur which would result in a box of cargo remaining at the discharge station. Subsequently approaching boxes of cargo carried by other descending cradles would then result in a cargo pileup in the absence of the discharge sensors of the present invention.

At the cargo loading station, cargo loading sensors are provided to synchronize the positioning of boxes of cargo so that the boxes are brought to the cargo loading space by sequentially interposing them between pairs of ascending cradles. Otherwise, an unsynchronized transfer of boxes of cargo would result in instances of laterally moving boxes of cargo striking ascending cradles, which could misposition the boxes and prevent them from being taken up by the cradles. Cargo pileups at the loading station would thus occur with considerable frequency.

The cargo transport device of the invention includes a supporting framework for positioning on the coaming of a hatch and from which an elongated vertically oriented elevator gantry is suspended by means of a hoist mechanism. The hoist may be used to raise and lower the elevator gantry as desired for withdrawing cargo from the hold of the ship.

The chains carrying the cradles travel within vertical channels formed by the structural members of the gantry and are provided with guides that restrain chain movement within the channels. The cradles are likewise constrained by projections that interact with the channels to prevent inordinate rotational motion from occuring in the elevator system.

A system of vertically extending rails is provided adjacent to the path of movement of both ascending and descending cargo boxes so that the boxes of cargo cannot become dislodged from the cradles and fall.

The framework of the vertical elevator gantry is constructed of modular cage-like units that can be fastened together end to end to create a vertical elevator structure of any desired length. Preferably, vertical standards of channel configuration are provided at the corners of the cage like modular sections and the chains travel within the confines of these channels, as previously noted. By forming the vertical standards with laterally extending apertures near the upper extremities thereof, a means is provided for inserting a lever to lift the portion of chain suspended thereabove to slacken that chain to allow chain links to be added or taken away from the endless loop.

BRIEF DESCRIPTION OF THE DRAWINGS

FIG. 3 is a plan view taken along the lines 3—3 of FIG. 1 illustrating a portion of the apparatus in detail.

FIG. 4 is a sectional view taken along the lines 4—4 of FIG. 3.

FIG. 16 is a front view of an alternative embodiment of the invention of FIG. 1.

FIG. 17 is a side elevational detail taken along the lines 17—17 of FIG. 16.

FIG. 18 is a sectional view taken along the lines 18—18 of FIG. 16.

FIG. 19 is a detail view of a portion of FIG. 18.

Figure 2:
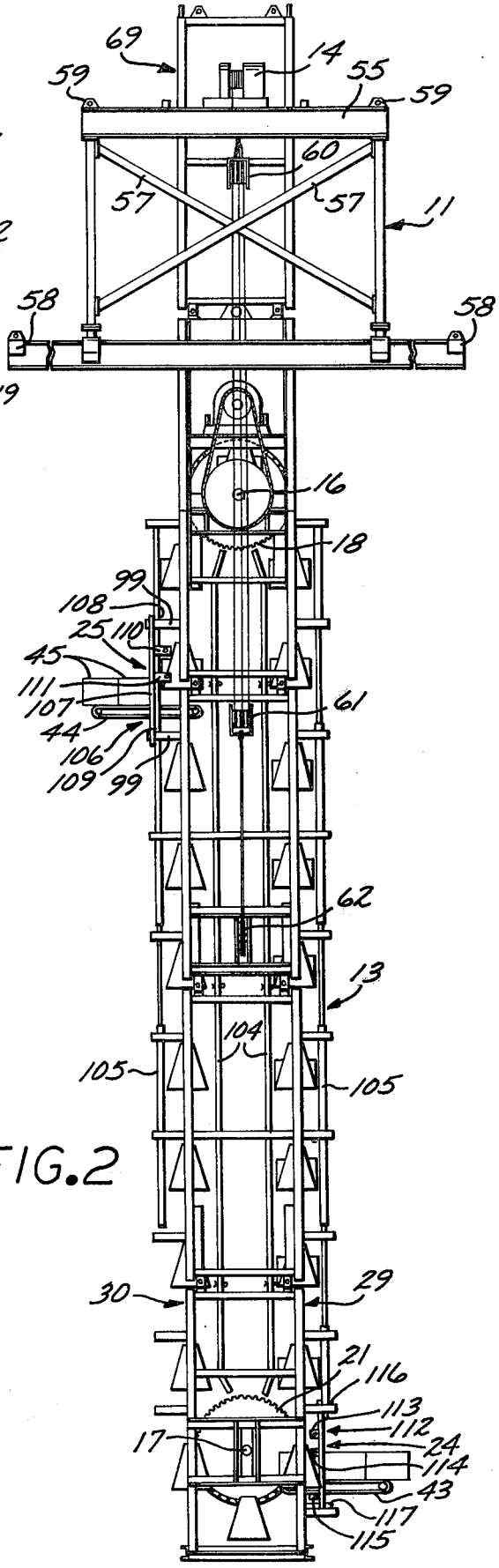
FIG. 2 is an elevational side view of the cargo transport apparatus taken at right angles to the view of FIG. 1.
Figure 11:
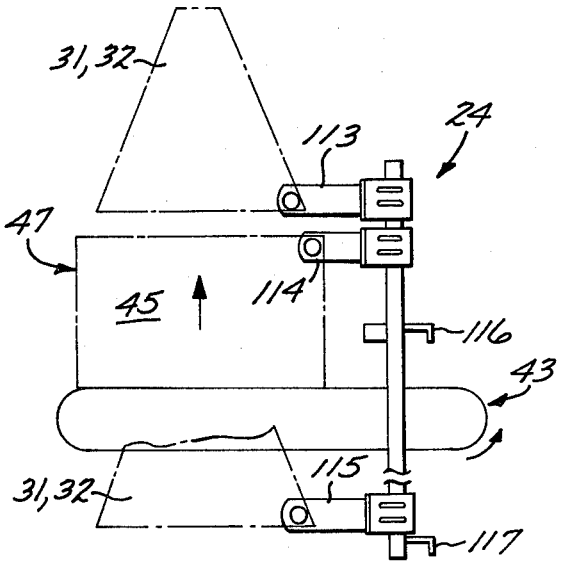
FIG. 11 illustrates operation of the loading sensors at the cargo loading station.
Figure 12:
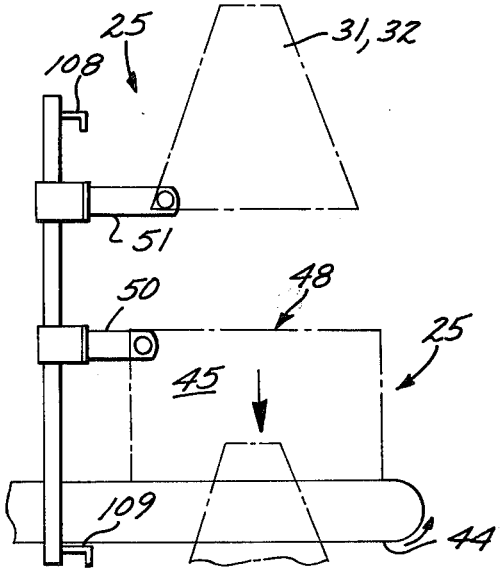
FIG. 12 illustrates the operation of the discharge sensors at the cargo unloading station.

The main structures of the invention include the skeletal supporting framework 11, the elongated vertical elevator gantry 13, the loading conveyor 43, the discharge conveyor 44, and the optical loading and unloading sensors of FIGS. 11 and 12 and the guide rails 104 and 105 depicted in FIG. 2.

Figure 1:
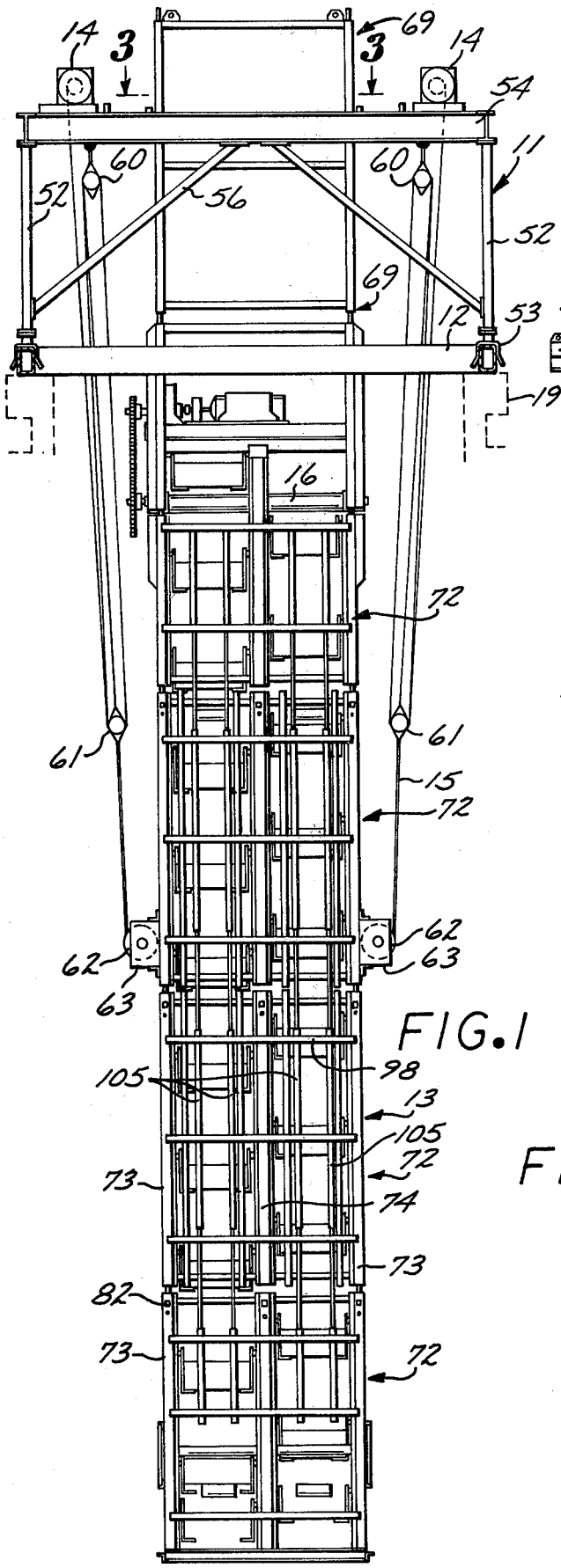
FIG. 1 is an elevational front view of the cargo transport apparatus emboding the present invention.

Referring now to FIGS. 1 and 2 the cargo transport device of the invention is depicted in its entirety. At the upper portion of the device a supporting framework 11 is provided which has a lower rectangular base 12 formed of structural steel tubing of generally rectangular cross section for positioning on the combing of a hatch of a cargo vessel, indicated in dashed lines at 19. Above the base 12, structural steel members generally outline the shape of a rectangular prism, the horizontal openings of which provide vertical access to the hold of a cargo vessel.

The cargo transport apparatus of the invention also includes a vertically extending elevator frame or gantry 13 also formed of structural steel members and defined generally in the shape of the outline of an elongated rectangular prism that is laterally encompassed at its upper extremity by the support framework 11. The elevator gantry 13 extends below the level of the exposed upper deck of the cargo vessel into the hold of a ship. The vertically extending elevator gantry 13 is connected to the support framework 11 by means of a hoist mechanism that includes a pair of winches 14 located on the supporting framework 11 on opposite sides of the gantry 13. A cable 15 is connected to the winches 14 and passes downward beneath sheaves 16 that are attached to the gantry 13 and rotatably secured in alignment with the winches 14, so that the elevator gantry 13 is suspended from the supporting framework 11 by means of the cable 15 in a pendulum fashion.

Figure 5:
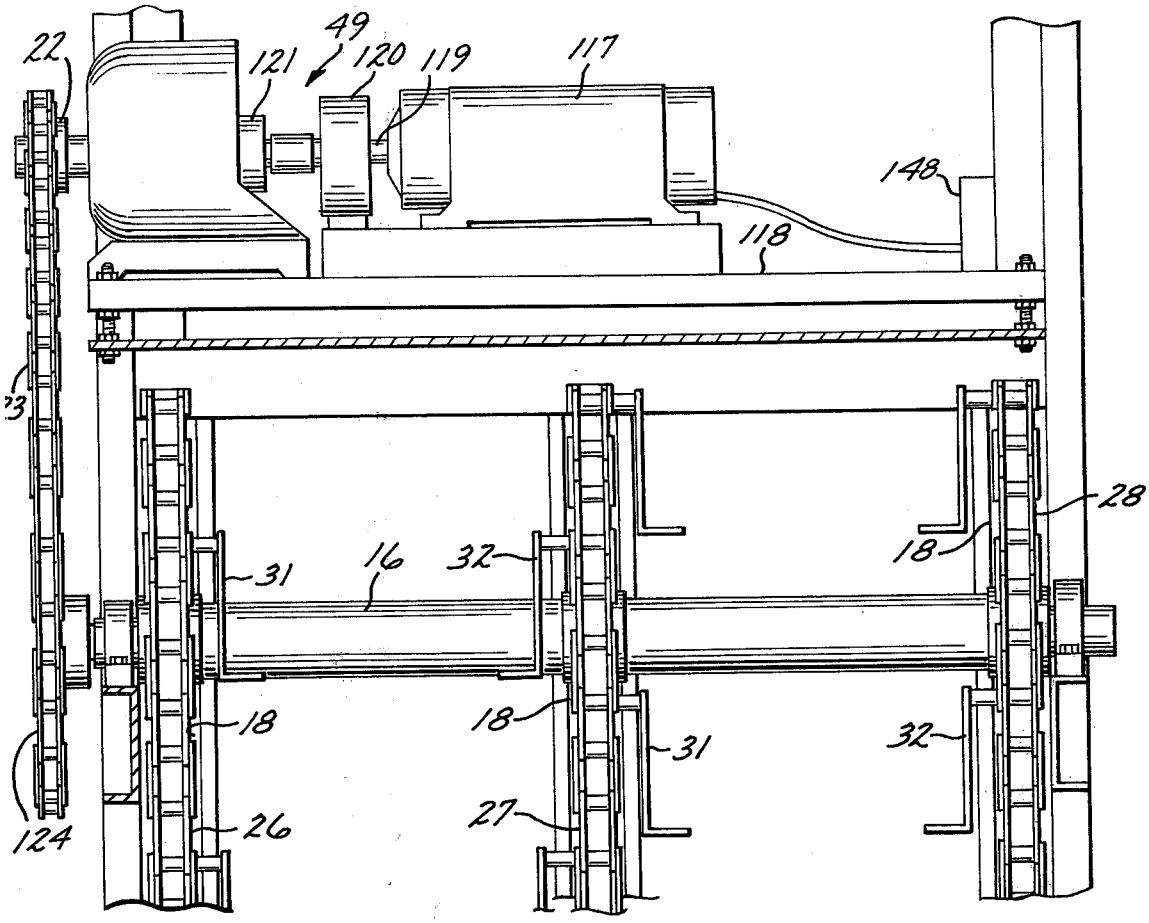
FIG. 5 is an enlarged elevational view taken in the plane of FIG. 1 showing the drive system for the elevator mechanism.

Parallel vertically aligned and horizontally extending upper and lower axles, numbered 16 and 17 respectively carry upper drive sprockets 18 and lower sprockets 21 as depicted in FIGS. 1, 2 and 5. The upper axle 16 is driven by an elevator drive system indicated at 49 in FIG. 5.

An electric motor 117 is the central driving element of the elevator drive mechanism 49. The motor 117 is preferably a variable speed alternating current motor, and is bolted on a platform 118 above the sprockets 18. The motor 117 turns a shaft 119 that operates through a brake and eddy current clutch mechanism 120 and a gear reducing transmission 121 to turn a drive sprocket 22. The drive sprocket 22 in turn advances a drive chain 23 that turns a larger sprocket 124 which is coupled directly to the driving axle 16. The driving axle 16 thereby provides power to both of the elevator lifts formed on the one hand between the chains 26 and 27 and on the other hand between the chains 27 and 28.

Separate driving motors are employed in connection with the loading conveyor 43 and the discharge conveyor 44. These conveyor drive motors also include a brake and clutch mechanism and are subject to the operation of the motor 117. That is, when the motor 117 is disabled the conveyor drive motors are likewise disabled. However, conveyor drive motors can be separately disabled even though the motor 117 continues to drive the sprockets 18.

The several vertically aligned upper sprockets 18 and lower sprockets 21 carry elevator conveyor chains 24, 26, 27 and 28 extending in vertically elongated endless loops. As noted, dual elevator shafts are formed between the adjacent chains, which are driven in tandem to form dual lift systems, as illustrated in FIGS. 1 and 5. The chains in each lift system lead from a loading station 24 on one side of the elevator gantry to an unloading station 25 on the opposite side of the gantry 13. Movement of the chains 26, 27 and 28 is synchronized since the sprockets 18 and 21 are mounted in fixed position on the axles 16 and 17 which rotate in tandem. Between the chains 26 and 27 and between the chains 27 and 28 an ascending pathway 29 is defined on one side of the gantry for each of the lift systems and extend upward from the cargo loading station 24. A descending pathway 30 extends downward and intersects the cargo unloading station 25 on the opposite side of the gantry from the pathway 29.

Figure 7:
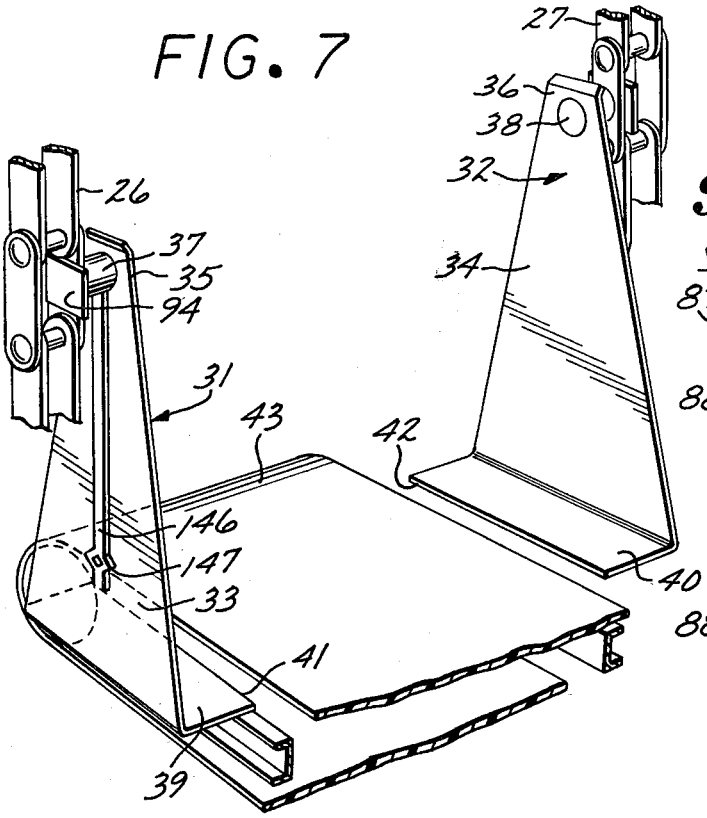
FIG. 7 is a perspective view of the cradles of the invention at the loading station.

A pair of cradles 31 and 32 is depicted in FIG. 7. The cradles 31 and 32 are laterally spaced apart within each of the elevator shafts formed by the elevator gantry 13 and are respectively connected to adjacent chains, such as the chains 26 and 27. The cradles 31 and 32 are formed by side hangers or trays 33 and 34 which are pivotally connected at their upper extremities 35 and 36 to the chains 26 and 27 respectively by means of rotatable pins 37 and 38. The cradles 31 and 32 extend downward from the pin connections 37 and 38 to hang in pendulum fashion. At the lower extremities of the triangular shaped panels or trays 33 and 34, the cradles 31 and 32 have edges that turn inwardly to form opposing lifting flanges 39 and 40 which terminate in edges 41 and 42 that are laterally spaced apart a sufficient distance to clear the loading and discharge conveyors, the loading conveyor 43 being depicted in FIG. 7. Because both the loading conveyor 43 of FIGS. 7 and 11 and the discharge conveyor 44 of FIG. 12 are narrower than the cargo boxes 45, the cradles 31 and are able to pick the cargo boxes 45 off of the loading conveyor 43 at the loading station 24 in FIG. 2. The cradles 31 and 32, carry the boxes 45 upward in the ascending pathway 29 until the boxes 45 are carried over the axle 16 whereupon the cradles enter the descending pathway 30. The boxes 45 are then deposited on the discharge conveyor 46, as depicted in FIG. 2. The boxes 45 are preferably of a standard size used for a particular purpose. For example, a standard size box for the shipment of bananas is about 21 inches in length, 16 inches in width and 9½ inches in height.

Figure 8:
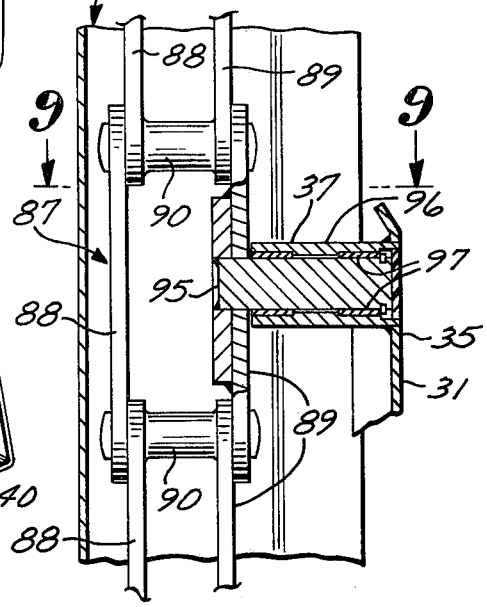
FIG. 8 is a sectional view showing a cradle interconnection to an elevator chain.

Each of the chains 26, 27 and 28 is formed of a series of longitudinally connected links 87, each of which includes a pair of oblong, thin vertical plates 88 and 89, as depicted in FIG. 8, which are joined to each other and to the vertical plates of adjacent links by laterally extending pins 90. In addition to the vertical plates 88 and the connecting pins 90, each of the chains 26, 27 and 28 includes a flat rectangular guide block 94 interiorally disposed and welded to the link plates 89 for those of the links 87 to which a cradle 31 or 32 is attached, as depicted in FIGS. 7 through 10. By utilizing the guide blocks 94, excessive fore and aft rotation of the chain links 87 is avoided, which rotation might otherwise result should a loaded pair of cradles 31 and 32 undergo excessive swinging action. Each of the mounting pins 37 and 38 includes an interior solid cylindrical shaft 95, depicted in FIG. 8, about which a sleeve 96 is concentrically mounted for rotation. Rotation is facilitated by roller bearings 97. The shaft 95 does not rotate, but is welded to the guide block 94, which in turn is welded to the link plate 89. The upper extremity 35 of the cradle 31 is welded to the sleeve 96 of the rotatable mounting pin 37.

The same type of optical beam reflection system is employed injunction with the loading conveyor 43 depicted in FIG. 11. At the loading station 24 it is important that cargo boxes 45 are not forced into the path of the trays 31 and 32 since this might result in jamming of the system. To prevent this from occurring, the optical sensor 115 detects an approaching pair of cradles 31 and 32 by reason of interruption of the lateral beam of light by these cradles. When interruption occurs the optical sensor 115 generates an inhibiting signal which is passed to the drive motor for the loading conveyor 43, but not to the elevator drive system 49. The inhibiting signal from the sensor 115 stops movement of the conveyor 43 so that no cargo box will be forced into the vertical path of the ascending cradles 31 and 32 until after these cradles have cleared the loading position 47. When the cradles have cleared the loading position, the horizontal beam of light from the loading sensor 113 is interrupted as the lower corners of the cradles 31, 32 pass upward past the sensor 113. The sensor 113 thereby generates a signal which terminates the inhibiting signal produced by the sensor 115. The conveyor 43 is thereby allowed to resume operation.

The inhibiting signal from the optical sensor 115 is itself suppressed however, when a signal is concurrently produced by the optical sensor 114. A signal will be generated by the optical sensor 114 when a cargo box 45 is in the cargo loading position 47 as indicated in FIG. 11. Thus, upon concurrence of interruption of the lateral beams of light from the sensors 114 and 115, the inhibiting signal from the sensor 115 is suppressed by the inhibit suppression signal from the sensor 114, and the loading conveyor drive mechanism is not disabled. This is because a cargo box 45 is in the cargo loading position 47 and will be picked up by the next sequential ascending pair of cradles 31 and 32. The system will not become jammed by pressure from a following cargo box 45, since this box cannot enter the cargo loading position 47 until the first box is removed. Thus, the conveyor can be kept moving continuously provided there is a queue of cargo boxes 45 awaiting entry to the loading station 24.

The supporting framework 11 of the cargo transport system includes a base 12 formed of hollow structural steel tubing welded at four corner connections to form a rectangular shape. Hollow structural steel tubing columns 52 extend vertically upward and have feet 53 formed generally in an inverted U-shaped configuration which fit over the tubing of the base 12 at locations interior of the corner extremities of the base 12. Atop the columns 52, I-beams 54 and 55 are provided to form a lateral rectangular access opening in the supporting framework 11. Stability is provided by hollow braces 56 of steel tubing that extend diagonally from the lower extremities of the columns 52 upwardly toward the centers of the I-beams 54 extending around the upper periphery of the supporting framework 11. Diagonal braces 57 are also hollow structural steel members and extend from the lower extremities of the columns 52 diagonally in a vertical plane to the upper extremity of an opposing column 52 adjacent the intersection of the I-beam 55 resting thereatop. Connection brackets 58 and 59 are welded to the rectangular base 12 and to the I-beams 55 respectively and include eyelets by means of which cables may be attached so that a crane can be used to lift the entire cargo transport apparatus and lower it into position on a cargo vessel.

The hoist mechanism by means of which the elevator gantry 13 may be raised and lowered relative to the supporting framework 11 includes two electrically powered winches 14 centrally located along the opposing I-beams 55 and mounted thereatop. Double blocks 60 depend from the underside of the I-beams 55 beneath the winches 14 and additional double blocks 61 are arranged in a block and tackle system as illustrated in FIGS. 1 and 2 by means of which the winches 14 are able to draw on a cable 15 with an increased ratio of power. The cable 15 is attached to the two opposing blocks 61 and passes underneath each of the sheaves 62 which are respectively rotatably mounted in coplanar vertical alignment for rotation about horizontal axes. The sheaves 62 are fastened to vertically oriented brackets 63, which in turn are fastened to the sides of the elevator gantry 13.

The elevator gantry 13 is carried in the position depicted in FIGS. 1 and 2 suspended from the supporting framework 11 and may be raised or lowered relative to the hold of a ship by the hoist mechanism. The gantry 13 is free to move short distances laterally relative to the supporting framework 11. These distances are limited by the four corner restraints 64 depicted in FIGS. 3 and 4 which are formed of structural steel angles and attached to horizontal deck plates 65 extending interiorally from the perimeter of the rectangular base 12. The corner restraints 64 thereby limit the lateral movement of the vertical standards 66 of the gantry 13 which are formed of square hollow steel tubing and which are interconnected by fore and aft horizontal tubular steel cross bars 67 and transverse tubular steel crossbars 68 that collectively outline a dummy section 69 of the elevator gantry 13. The dummy section 69 is formed generally in the outline of the shape of a rectangular prism, as are all of the modular sections 72 of the elevator gantry 13, hereinafter to be described. The dummy section 69 is located perdominantly above the horizontal axle 16 carrying the sprockets 18. The dummy section 69 therefor does not form a part of the elevator shafts within which the boxes 45 of cargo are carried, but rather serves to vertically extend the elevator gantry 13 upward so that the gantry 13 may be laterally restrained by the reinforced corner restraints 64.

The corner restraints 64 are formed of angles and are of concave plan section, as depicted in FIG. 3, and of convex elevational section, as depicted in FIG. 4. Thus, the corner restraints 64 are formed of welded pieces of different angle segments joined along a horizontal plane. The corner restraints 64 thereby limit the maximum lateral movement and angle of inclination of the elevator gantry 13. This limitation becomes necessary by virtue of movement of the ship. Such movement causes a change in alignment of the gantry 13 relative to the supporting framework 11 both when the gantry is suspended therefrom and also when the gantry is lowered to rest on the floor of the ship's hold. The limitation in movement imposed by the corner restraints 64 prevents the gantry 13 from moving laterally a distance greater than the sum of distances of separation of the corner restraints 64 from the vertical standards 66, as depicted in FIG. 3. The gantry 13 is also prevented from deviating beyond the angles of inclination indicated in dashed lines at 70 and 71 in FIG. 4 relative to the supporting framework 11.

The elevator gantry 13 is formed of linearly connected sections 72 each having rectilinear structural members that outline the shape of a rectangular prism as explained in connection with the dummy section 69 depicted in FIGS. 3 and 4.

Figure 9:
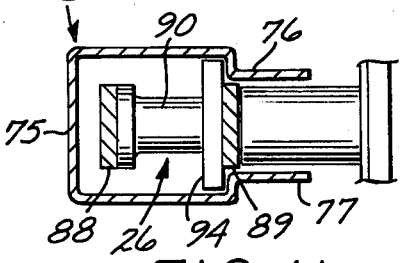
FIG. 9 is a cross sectional view through a corner vertical standard taken along the lines 9—9 of FIG. 8.
Figure 10:
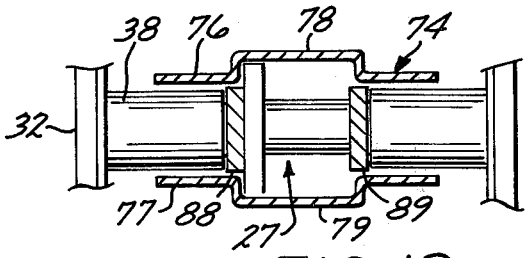
FIG. 10 is a cross ectional view through an interior vertical standard used in the elevator gantry construction.

The upright vertical standards 73 and 74 of the modular sections 72 are formed with vertical walls that define channels within which the chains 26, 27, and 28 travel, as depicted in FIGS. 9 and 10. The vertical standards 73 at the corners of the sections 72 are elongated members of generally U-shaped configuration, as depicted in FIG. 9, having a spine 75 from which interior and exterior walls 76 and 77 extend. On the open side of the channel, the walls 76 and 77 indent slightly to produce an overhang to entrap the chain therein and also to serve as limits to the movement of the guide projections 147 from the cradles 31 and 32 as depicted in FIG. 7 to then act as guide channels. Similarly, the intermediate vertical standards 74 act as guide channels and include interior and exterior walls 78 and 79 respectively. The walls 78 and 79 have double overhangs as depicted in FIG. 10 since two ends of the channels defined therebetween are open. The channels thus formed by the standards 73 and 74 laterally encapsulate the chains 26, 27 and 28.

Figure 6:
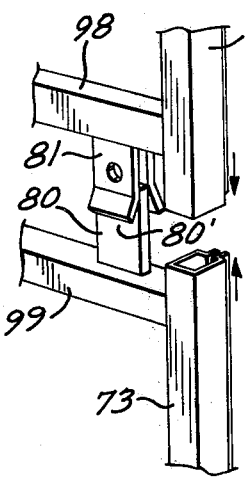
FIG. 6 is a detail showing the interconnection of modular sections of the elevator gantry.

As depicted in FIG. 6, the modular sections 72 each have upwardly extending vertical connecting tabs 80 with lateral apertures 80' therethrough, and lower downwardly extending slotted brackets 81 likewise having lateral apertures 81' therethrough and which meet and receive upwardly extending tabs 80 from an adjacent lower section 72. When the two adjacent sections 72 are moved together as indicated by the arrows in FIG. 6 so that the apertures in the brackets 81 and the tabs 80 are aligned, a pin may be inserted through the brackets and tabs to lock the sections together. This pin may be any conventional fastener such as a cotter pin, a bolt, or other fastening mechanism. Preferably, the pin is easily releasable so that sections may be readily assembled together and disassembled.

Figure 13:
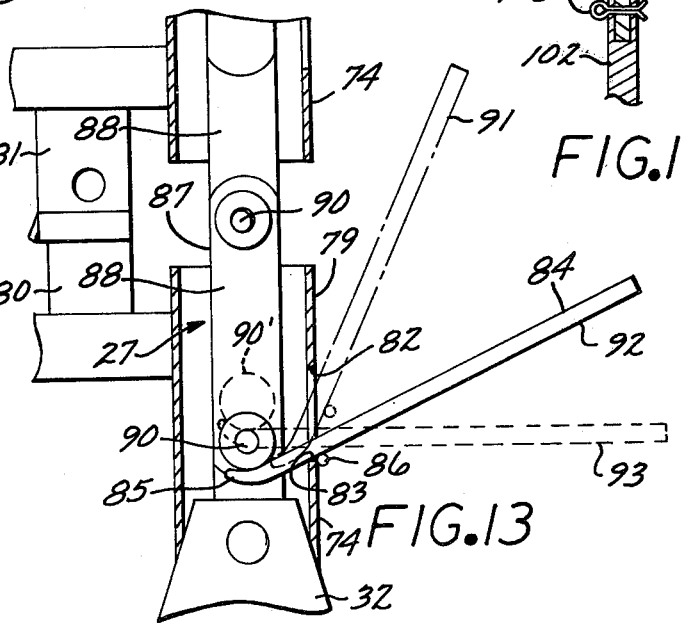
FIG. 13 is an elevational sectional detail of an interior vertical standard illustrating the slackening of an elevator chain.

Preferably, the upright standards, such as the standard 74 in FIG. 13, include an aperture as at 82 defined in the exterior wall 79 near the upper extremity thereof. The lower surface 83 of the aperture 82 is thereby able to serve as a fulcrum for an elongated lever 84 which may be inserted in the aperture 82. The lever 84 includes an arcuate tip 85 and a transverse positioning bar 86 welded theretho. The lever 84 is then inserted so that the curved tip 85 projects through the aperture 82 and beneath the pin 90 of a link 87 of one of the chains, such as the chain 27 to the position depicted in dashed lines at 91 in FIG. 13. The lever 84 is then rotated clockwise downward in FIG. 13 to the position indicated in solid lines at 92, whereupon the tip 85 engages the pin 90 and the positioning bar 86 rests snugly against the lower edge 83 of the aperture 82. Downward clockwise rotation is continued until the lever 84 assumes the position depicted in dashed lines at 93 in FIG. 13, which forces the pin 90 to the position indicated at 90'. In this position the chain is slackened at all points above the lever 84, thereby allowing selected pins 90 to be removed to permit the addition and deletion of links 87 from the chain 27. Chains 26 and 28 may similarly be altered in length.

Each of the sections 72 includes transverse cross bars 98 and fore and aft cross bars 99 which, when joined to the upright standards 73 and 74, define a cage-like structure generally in the form of a rectangular prism. To each of the transverse cross bars 98 are fastened several inwardly facing guide rail locks 100 arranged in vertical alignment. These guide rail locks may take the form of arcuate portions of annular sleeves through the wall of which a radially directed set screw 101 is threadably engaged. The guide rail locks 100 serve to receive and secure vertically extending guide rails formed of linearly linked guide rail segments 102. The guide rail segments 102 are each of a length corresponding to the length of the vertical standards 73 and 74 of the modular sections 72 of the vertically extending elevator gantry 13.

Figure 14:
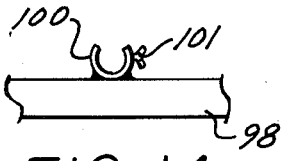
FIG. 14 illustrates the mounting of a guide rail lock.
Figure 15:
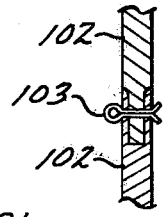
FIG. 15 illustrates the coupling of guide rail segments.

The linear guide rail segments 102 are equipped with ends that fit in telescoping relationship one to another, as depicted in FIG. 15. For installation, a guide rail segment 102 is entrapped within the channel formed by the guide rail lock 100 and moved longitudinally prior to setting of the set screw 101. Linearly adjacent guide rail segments 102 may then be coupled by cotter pins 103, as depicted in FIG. 15, and the set screw 101 of FIG. 14 thereafter is tightened. When linked together the guide rail segments 102 are used to form ranks of interior guide rails 104, as depicted in FIG. 2 and ranks of exterior guide rails 105 as depicted in that figure. Preferably, the guide rails 103 and 105 are placed two abreast with respect to each ascending and descending pathway of the cradles 31 and 32 of the invention. Since, in the embodiment depicted, there are two adjacent elevator shafts, four vertically extending guide rails 104 are provided in each of two parallel ranks, one rank delineating the interior boundary of the ascending pathway 29 for both of the two parallel elevator shafts and the other rank of vertically extending guide rails 104 delineating the interior boundary of the descending pathway 30 for both of the parallel shafts. Similarly, a rank of four guide rails 105 delimits the exterior extremity of the ascending pathway 29 for both of the parallel shafts, while a second rank 105 defines the outer boundary of the descending pathway 30 of both of the parallel elevator shafts.

The guide rails 103 and 105 are positioned parallel to the ascending and descending pathways 29 and 30 respectively and close to the cradles 31 and 32 to define the confining elevator shafts to prevent boxes 45 of cargo from dislodging and falling from the cradles. There is insufficient clearance for a box 45 to pass over the transverse edges of the cradles 31 and 32 and fall.

It should be noted that the structure of the modular sections 72 is such that the guide rail sections 102 may be removed from a selected section 72. With guide rail sections 102 removed, the framework of the section 72 is such that the transverse cross bars 98 and fore and aft cross bars 99 are positioned so that a cargo unloading rack support 106 or a cargo loading rack support 112 may be hung in the opening created by the missing rail segments 102. The unloading rack support 106 is illustrated in FIG. 12 and is comprised of vertically extending posts 107 which have hooks 108 and 109 that extend over the transverse cross bars 98 and the fore and aft cross bars 99 in the manner depicted in FIG. 2. The unloading rack support 106 has connections for mounting the optical sensors 50 and 51 and for mounting the laterally extending discharge conveyor 44. Thus the entire unloading rack support assembly 106 may be removed from the gantry 13 by merely lifting it so that the hooks 108 and 109 are no longer engaged with the cross bars of the gantry section 72. The unloading rack support 106, once lifted, carries with it the discharge sensors 50 and 51 and the discharge conveyor 44, and can be hung on the vertically extending gantry frame 13 at any one of a plurality of selected levels at different ones of the sections.

In a similar manner, the cargo loading rack support 112 carrying the loading sensors 113, 114 and 115 can be hung in an opening in one of the sections 72 on the fore and aft cross bars 99 and the transverse cross bars 98 by means of laterally projecting hooks 116 and 117 at any one of a plurality of selected levels. The cargo loading rack support 112 includes vertical posts 111 that carry the optical sensors 113, 114, and 115 as well as the laterally projecting loading conveyor 43.

An alternative embodiment of the invention is depicted in FIGS. 16–19. In this embodiment an alternative type of elevator gantry 125 is employed which includes dual enlcosed elevator lifts, denoted generally by the elevator shafts 149 and 150 in FIG. 18, each operating between two synchronized chains which advance together in different parallel planes, as in the embodiment of FIGS. 115. In addition, however, the alternative embodiment also employs on the outermost chains 127 and 128 unitary cradles 126. Each of the cradles 129 includes a vertically oriented downwardly extending portion 130 which depends from connections 131 and 132 to the chains 127 and 128 respectively. In addition, the cradles 126 include laterally extending platforms 133 that extend laterally outward at the ends of the gantry 125 to support boxes 45 of cargo. The platforms 133 of the cradles 126 are unitary shelves extending outward from the vertical panels 130 at the lower extremities thereof and perpendicular to the planes in which the single chain 127 or 128, with which they are associated, moves, as best illustrated in FIG. 17.

The platforms 133 are of a width narrower than the cargo boxes 45. The cargo loading station 134 of FIG. 19 includes a horizontally projecting loading conveyor 135 directed at an ascending portion of the chains 127 or 128 in a direction perpendicular to the plane of chain movement. The loading conveyor 135 terminates short of intersecting the vertical movement of the lateral platforms 133 of the cradles 126, however. To carry the boxes 45 from the loading conveyor 135 on to the platforms 133, laterally extending edge transport belts 136 are employed, the edge transport belts are narrow V-belts driven by horizontally aligned pulleys 137 two of which, at least, bracket the vertical path of movement of the cradles 126 as these cradles ascend.

A comparable arrangement is provided at the cargo unloading station 140, depicted in FIG. 19. At each of the cargo unloading stations, 140, a horizontally projecting discharge conveyor 141 extends perpendicular to the plane of movement of the chains 127 and 128. The discharge conveyor 141 advances in the direction indicated by the arrow in FIG. 19 so that boxes 45 are directed away from a descending length of the chains 127 and 128 from a location just beyond the path of vertical movement of the descending platforms 133 of the trays 126. Horizontally oriented edge transport V-belts 145 bracket the descending path of vertical movement of the lateral platforms 133 and extend to the discharge conveyor 141. Thus, a box 45 of cargo overhanging both sides of the platform 133 of one of the descending cradles 126, as depicted in FIG. 19, is carried from the platform 133 by the edge transport belts 145, which deposit the box 45 on the discharge conveyor 141 and carry it from the elevator gantry 125.

By employing the alternative embodiment of the invention, four elevator lift systems are provided in a relatively compact cross sectional area.

OPERATION OF THE INVENTION

Referring to the principal embodiment of FIGS. 1 through 15, the manner of operation of the system proceeds from a starting signal. The starting signal is typically an electrical signal from an operators panel which is passed to a delay and warning alarm circuit located within the housing 147 in FIG. 5. The delay and warning circuit introduces a 10 second delay into the starting signal to the motor 117 of the elevator drive system 49. During this 10 second delay, a warning bell or buzzer sounds so that all in the area are aware that the conveyor system is about to begin operation and that the gantry 13 should be cleared of all human activity. After the 10 second delay, the motor 117 begins operation to drive the sprocket 22 which in turn acts through the sprocket 124 to turn the axle 16. Concurrently, actuating signals are fed to the drive motors for the loading conveyor 43 and for the discharge conveyor 44. Typically the discharge conveyor 44 will be operated to advance the boxes 45 at a greater speed than either the elevator drive system 49 or the loading conveyor drive system.

The loading conveyor 43 begins advancing boxes of cargo 45 toward the cargo loading station 24. As previously explained, this advancement will be periodically interrupted and the conveyor 43 will be halted upon receipt of a signal indicating interruption of the reflected light beam at the optical sensor 115 in FIG. 11. Advancement of the conveyor 43 will be resumed upon receipt of a signal from the optical sensor 113, indicating that the cradles 31 and 32 have cleared the loading space 47 and that the advancement of the conveyor 43 can be resumed. This stopping and starting motion of the conveyor 43 is continued until a box 45 is position at the loading space 47. In this situation interruption of the reflected light beam by the sensor 115 is accompanied by interruption of the light beam from the sensor 114, which is blocked by the cargo box 45 at the cargo loading position 47. The signal from the sensor 114 suppresses the inhibiting signal from the sensor 115 and advancement of the loading conveyor 43 continues as long as a cargo box 45 is available to be propelled into position in the loading space 47 as each new pair of cradles 31 and 32 approaches.

The cargo boxes 45 are carried upward as in FIG. 2 along the right hand side of the gantry 13 in the ascending path 29. As the cargo boxes 45 are lifted, they are entrapped between the interior and exterior rails 104 and 105 so that they can not fall out from the gantry 13. The boxes 45 are carried upward by the suspended cradles 31 and 32 and travel over the axle 16 and begin a descending movement in the descending path 30 at the left hand side of FIG. 2. As the cargo boxes 45 are brought to the unloading station 25, they are deposited on the discharge conveyor 44 while the flanges 39 and 40 pass downward to either side of the discharge conveyor 44. Propulsion of the discharge conveyor 44 carries the boxes from the cargo unloading area 48 of FIG. 12 prior to the approach of a subsequent pair of cradles 31 and 32.

If for any reason a box 45 remains at the cargo unloading position 48 at the cargo unloading station 25, the presence of such a box will be sensed by the optical sensor 50. As the next sequential pair of cradles 31 and 32 descends, the beam of light of the optical sensor 51 is interrupted, as in FIG. 12, and operation of the elevator drive system 49 is halted and an alarm located within the housing 148 is sounded. Operation of the drive system 49 will not be resumed until the box 45 has been removed from the cargo unloading position 48. In addition, the drive systems for the loading conveyor 43 and discharge conveyor 44 are disabled until this situation is cleared.

Stability of the cradles 31 and 32 during ascent in the ascending path 29 and descent and in the descending path 30 is assured by the guide blocks 94, depicted in FIGS. 7–10 which coact with the channel shaped vertical standards 73 and 74 to prevent excessive fore and aft rotation of the cradles 31 and 32. Guidance against such further excessive rotation is assured by means of guide ridges 146 which project vertically downwardly on the opposite outside surfaces of the respective trays 33 and 34 and terminate at their respective lower extremities in diamond shaped guide sliders 147. The ridges 146 and guide slider 147 extend laterally outwardly in the direction opposite to the flanges 39 and 40 and act against the confines of the walls 76 and 77 of the standard channels 73 and the standard walls 78 and 79 of the channels 74.

In the operation of the embodiment of FIGS. 16 through 19, a starting signal is initiated to actuate an elevator drive system as with the embodiments of FIG. 1 through 15. After the ten second warning interval, the chains 127 and 128 are turned and the cradles 126 begin to ascend. At the cargo loading stations 134 the load conveyor 135 propels cargo boxes 45 toward the edge transport belts 136, which engage the bottom of the boxes 45 at the outermost edges thereof and carry these boxes sequentially forward into position so that they are picked up by the next sequential platform 133 as it ascends to the cargo loading station 134. The platform 133 passes between the edge transports 136 to seize the box 45 and carry it upward.

At the cargo unloading station 140, descending cradles 126 pass between edge transports 145 that engage the bottoms of the boxes 45 and carry them away from the gantry 126 and onto the discharge conveyor 141.

The various other features of the embodiment of FIGS. 1–15 are also available with the embodiment of FIGS. 16–19. That is, a hoist arrangement employing winches 14 and sheaves 62 can be used to raise and lower the elevator gantry 125. Also the guide blocks 94 of FIG. 9 and the sliders 147 of FIGS. 7 and 8 can be used to stablize the cradles 126. The gantry 125 can be constructed in modular sections, such as the sections 72' and attached in the manner depicted in FIG. 5. Vertically extending rails 104 and 105 similarly can be fastened within the gantry to restrain the cargo boxes 45 and prevent them from falling utilizing the connections depicted in FIGS. 14 and 15. The optical sensors of FIGS. 11 and 12 can likewise be used at the cargo loading station 134 and the cargo unloading stations 140 respectively.

It is to be understood that numerous variations and modifications of the embodiments depicted herein will become readily apparent to those skilled in the art, and accordingly, the invention should not be limited to those particular structures depicted, but rather is defined in the claims appended hereto.

I claim:

1. Automatic cargo transport apparatus for transferring discrete units of cargo from one level to another level and comprising:

a vertically extending frame;

upper and lower sprockets mounted on said frame for rotation about horizontal axles above and below said respectively one and another levels;

endless chain means extending between and over said upper and lower sprockets to lead from a loading station having a loading space on one side thereof to an unloading station having an unloading space on the opposite side thereof;

drive means for rotating said sprockets to drive said chain means in unison in opposite ascending and descending directions on opposite sides of said sprockets;

sets of separate vertically extending horizontally spaced apart guide channels rigidly connected to said frame on both of said opposite sides of said sprockets and vertically located between the levels of said upper and lower sprocket axles;

a plurality of cradles including respective pairs of vertically elongated trays arranged in vertically spaced apart relationship along said chain and in opposed pairs, said respective trays extending downwardly adjacent respective guide channels, each pair of trays being formed on their lower extremities with opposed inwardly turned flanges and terminating in edges spaced from one another to define said loading space at said loading station and to define said unloading space at said unloading station;

pivot pin means pivotally mounting the upper portions of said respective trays from said chain means, said pivot pin means being received, at least in part, slidably in said respective channels;

guide sliders mounted on said respective trays and slidably received in said respective guide channels said sliders cooperating with said respective pivot pin means to restrain said trays against surging about said respective pivot pin means;

vertically extending cargo guiding means rigidly secured to said frame and co-extensive with said guide channels;

cargo loading means at said loading station for loading cargo into said cradles at said loading space; and cargo discharge means at said unloading station for receiving cargo from said cradles at said unloading space, said discharge means being sufficiently narrow for said flanges to pass to either side thereof so said drive means may be actuated to carry said trays past said loading means to engage said pairs of flanges under the opposite bottom corners of said units of cargo to lift said units of cargo off said loading means at said loading space and to carry them to said unloading station to be automatically discharged onto said discharge means at said unloading space as said lifting flanges pass downwardly on either side therepast.

2. Cargo transport apparatus as set forth in claim 1 wherein:

said discharge means includes discharge sensor means for detecting the presence of one of said discrete units of cargo at said unloading space and for detecting a pair of descending trays approaching said unloading station and for generating a disabling signal to said drive means upon the concurrence thereof, thereby suspending operation of said drive means, and a discharge conveyor projecting laterally between the paths of descending flanges of said pairs of trays and defining the lower limit of said unloading space, and including a discharge conveyor drive means responsive to said disabling signal to deactivate said discharge conveyor upon receipt thereof.

3. Cargo transport apparatus as set forth in claim 1, wherein:

said loading means includes a horizontally projecting loading conveyor extending between the paths of ascending flanges of said pairs of trays and defining the lower limit of said loading space, and including a loading conveyor drive means, and further including loading sensor means for detecting a pair of ascending trays approaching said unloading station and for generating an inhibiting signal to said loading conveyor drive means to inhibit operation thereof, and for detecting a pair of ascending trays departing said loading station to terminate said inhibiting signal to allow said loading conveyor drive means to resume operation.

4. The cargo transport apparatus of claim 3 wherein said loading sensor means further includes means for detecting a unit of cargo on said loading conveyor proximate to said loading space and for generating an inhibit suppression signal in response thereto to prevent said inhibit signal from inhibiting operation of said loading conveyor drive means.

5. Cargo transport apparatus as set forth in claim 1 further characterized in that a plurality of pairs of laterally spaced apart upper and lower sprockets are provided along with a corresponding plurality of pairs of endless chain means and corresponding pluralities of cargo loading means, and cargo discharge means, thereby defining a corresponding plurality of loading and unloading spaces, whereby, a plurality of tandem operated cargo transfer lifts are provided.

6. The automatic cargo transport apparatus of claim 1 wherein said vertically extending cargo guiding means comprises vertically extending guide rails spaced both inwardly and outwardly from each ascending and descending portion of said chain means on both of said opposite sides of said sprockets and interiorally located relative to the spacing of said elongatged trays, and terminating to define gaps at said loading space and at said unloading space on the sides of said pairs of sprockets at which said chain means ascend and descend respectively, whereby said cargo loading means and said cargo discharge means extend transversely into said gaps.

7. The automatic cargo transport apparatus of claim 1 further characterized in that said chain means are separate chains formed of links each having a pair of vertical plates joined to each other and to the vertical plates of adjacent links by upper and lower laterally extending pins, and a rectangular guide block is securely attached to one of said vertical plates of those links to which said cradles are pivotally mounted, whereby said guide blocks coact with the walls of said channels to limit rotation of said chain links to which said cradles are mounted.

8. Automatic cargo transport apparatus according to claim 1 further comprising discharge sensor means for detecting the presence of one of said discrete units of cargo at said unloading space and for detecting a pair of descending trays approaching said unloading station and for generating a disabling signal to said drive means upon the concurrence thereof, thereby suspending operation of said drive means, and loading sensor means for detecting a pair of ascending trays approaching said loading station and for generating an inhibiting signal to said loading conveyor drive means to inhibit operation thereof, and for detecting a pair of ascending trays departing said loading station to terminate said inhibiting signal to allow said loading conveyor drive means to resume operation, and further characterized in that said discharge sensor means and said loading sensor means are comprised of phototransmitters and corresponding proximately located photoreceptors shielded from direct optical communication therewith and a corresponding reflector is located opposite each associated phototransmitter and photoreceptor and at said loading station.

9. Automatic cargo transport apparatus as set forth in claim 1 and including:

a supporting framework defining a central access aperture for receiving said frame and adapted for mounting on the coaming of a hatch to a hold of a cargo ship with said central access aperture directed into said hold; and hoist means connected to said vertically extending frame supporting framework and suspending said vertically extending frame from said supporting framework whereby said vertically extending frame maintains a vertical alignment despite movement of the supporting framework with the ships upon which it is mounted.

10. Automatic cargo transport apparatus as set forth in claim 1 that includes:

vertically elongated guide blocks rigidly mounted on said respective pivot pin means and received slidably in said channel guides and restrained therein against rotation to restrain said trays against rotation.

11. Automatic cargo transport apparatus for transferring discrete units of cargo from one level to another level and comprising:

a vertically extending frame including horizontal cross bars extending transversely and fore and aft to divide said frame into equal vertically aligned sections;

a pair of laterally spaced apart upper and lower sprockets mounted on said frame above and below said respective one and another levels;

a pair of endless chain means extending between and over said upper and lower sprockets to lead from a loading station having a loading space on one side thereof to an unloading station having an unloading space on the opposite side thereof;

drive means for rotating said sprockets to drive said chain means in unison in opposite ascending and descending directions on opposite sides of said pairs of sprockets;

a plurality of cradles including respective pairs of elongated trays, pivotally mounted on their upper extremities from said chain means in vertically spaced apart relationship and in opposed pairs, each pair of trays being formed on their lower extremities with opposed inwardly turned flanges and terminating in edges spaced from one another to define said loading space at said loading station and to define said unloading space at said unloading station;

cargo loading means at said loading station for loading cargo into said cradles at said loading space;

cargo discharge means at said unloading station for receiving cargo from said cradles at said unloading space, said discharge means being sufficiently narrow for said flange to pass to either side thereof whereby said drive means may be actuated to carry said trays past said loading means to engage said pairs of flanges under the opposite bottom corners of said units of cargo to lift said units of cargo off said loading means at said loading space and to carry them to said unloading station to be automatically discharged onto said discharge means at said unloading space as said lifting flanges pass downwardly on either side therepast;

discharge sensor means for detecting the presence of one of said discrete units of cargo at said unloading space and for detecting a pair of descending trays approaching said unloading station and for generating a disabling signal to said drive means upon the concurrence thereof thereby suspending operation of said drive means; and a cargo unloading rack support having an opening therein to receive and support said laterally projecting discharge conveyor and said discharge sensor means and including laterally projecting hooks to extend over said crossbars, whereby said cargo loading rack support can be hung on said vertically extending frame at any one of a plurality of selected levels.

12. Automatic cargo transport apparatus for transferring discrete units of cargo from one level to another level and comprising:

a vertically extending frame including horizontal crossbars dividing said frame transversely and fore and aft into equal vertically aligned sections;

a pair of laterally spaced apart upper and lower sprockets mounted on said frame above and below said respective one and another levels;

a pair of endless chain means extending between and over said upper and lower sprockets to lead from a loading station having a loading space on one side thereof to an unloading station having an unloading space on the opposite side thereof;

drive means for rotating said sprockets to drive said chain means in unison in opposite ascending and descending directions on opposite sides of said pairs of sprockets;

a plurality of cradles including respective pairs of elongated trays, pivotally mounted on their upper extremities from said chain means in vertically spaced apart relationship and in opposed pairs, each pair of trays formed on their lower extremities with opposed inwardly turned flanges and terminating in edges spaced from one another to define said loading space at said loading station and to define said unloading space at said unloading station;

cargo loading means at said loading station for loading cargo into said cradles at said loading space;

cargo discharge means at said unloading station for receiving cargo from said cradles at said unloading space, said discharge means being sufficiently narrow for said flanges to pass to either side thereof whereby said drive means may be actuated to carry said trays past said loading means to engage said pairs of flanges under the opposite bottom corners of said units of cargo to lift said units of cargo off said loading means at said loading space and to carry them to said unloading station to be automatically discharged onto said discharge means at said unloading space as said lifting flanges pass downwardly on either side therepast;

discharge sensor means for detecting the presence of one of said discrete units of cargo at said unloading space and for detecting a pair of descending trays approaching said unloading station and for generating a disabling signal to said drive means upon the concurrence thereof suspending operation of said drive means; and a cargo loading rack support having an opening therein is provided to receive and support said horizontally projecting loading conveyor, and has laterally projecting hooks to extend over said crossbars, whereby said cargo loading rack support can be hung on said vertically extending frame at any one of a plurality of selected levels.

13. Automatic cargo transport apparatus for transferring discrete units of cargo from one level to another level and comprising:

a vertically extending frame including modular disengageable sections of rectilinear construction, including vertical standards and transverse and fore and aft horizontal cross bars interconnecting said vertical standards;

a pair of laterally spaced apart upper and lower sprockets mounted on said frame above and below said respective one and another levels;

upper and lower connecting means on each of said modular sections, and on both of said opposite sides of said sprockets, for effectuating connections to vertically adjacent sections;

a pair of endless chain means extending between and over said upper and lower sprockets to lead from a loading station having a loading space on one side thereof to an unloading station having an unloading space on the opposite side thereof;

drive means for rotating said sprockets to drive said chain means in unison in opposite ascending and descending directions on opposite sides of said pairs of sprockets;

a plurality of cradles including respective pairs of elongated trays, pivotally mounted on their upper extremities from said chain means in vertically spaced apart relationship and in opposed pairs, each pair of trays being formed on their lower extremities with opposed inwardly turned flanges and terminating in edges spaced from one another to define said loading space at said loading station and to define said unloading space at said unloading station;

cargo loading means at said loading station for loading cargo into said cradles at said loading space;

cargo discharge means at said unloading station for receiving cargo from said cradles at said unloading space, said discharge means being sufficiently narrow for said flange to pass to either side thereof whereby said drive means may be actuated to carry said trays past said loading means to engage said pairs of flanges under the opposite bottom corners of said units of cargo to lift said units of cargo off said loading means at said loading space and to carry them to said unloading station to be automatically discharged onto said discharge means at said unloading space as said lifting flanges pass downwardly on either side therepast; and discharge sensor means for detecting the presence of one of said discrete units of cargo at said unloading space and for detecting a pair of descending trays approaching said unloading station and for generating a disabling signal to said drive means upon the concurrence thereof thereby suspending operation of said drive means.

14. The automatic cargo transport apparatus of claim 13 further characterized in that said chain means are separate chains formed of disconnectable links joined by laterally extending removable pins joining said links, and said vertical standards are of channel configuration having vertically extending inner and outer walls confining the movement of said chains, and an aperture is formed in the outer walls of at least some of said vertical standards near the upper extremities thereof, whereby the lower edges of said apertures serve as fulcrums for a lever insertable through said apertures to slacken the portions of said chains thereabove, thereby allowing the insertion and removal of said pins to permit the addition and deletion of links from each of said chains.

* * * * *